US010738950B2

(12) United States Patent
Khrushchev

(10) Patent No.: US 10,738,950 B2
(45) Date of Patent: Aug. 11, 2020

(54) LIGHTING DEVICE COMPRISING A PUMP RADIATION SOURCE

(71) Applicant: OSRAM GmbH, Munich (DE)

(72) Inventor: Sergey Khrushchev, Regensburg (DE)

(73) Assignee: OSRAM Beteiligungsverwaltung GmbH, Grünwald (DE)

( * ) Notice: Subject to any disclaimer, the term of this patent is extended or adjusted under 35 U.S.C. 154(b) by 175 days.

(21) Appl. No.: 15/767,667

(22) PCT Filed: Oct. 5, 2016

(86) PCT No.: PCT/EP2016/073705

§ 371 (c)(1),
(2) Date: Apr. 12, 2018

(87) PCT Pub. No.: WO2017/071919

PCT Pub. Date: May 4, 2017

(65) Prior Publication Data

US 2018/0274738 A1 Sep. 27, 2018

(30) Foreign Application Priority Data

Oct. 27, 2015 (DE) ..... 10 2015 220 948

(51) Int. Cl.
*F21K 9/64* (2016.01)
*F21S 41/32* (2018.01)
(Continued)

(52) U.S. Cl.
CPC ..... *F21K 9/64* (2016.08); *F21S 41/14* (2018.01); *F21S 41/16* (2018.01); *F21S 41/321* (2018.01);
(Continued)

(58) Field of Classification Search
CPC ..... F21K 9/64; F21V 9/30
See application file for complete search history.

(56) References Cited

U.S. PATENT DOCUMENTS 5,675,593 A * 10/1997 Oka ..... H01S 3/109 372/21
2007/0081336 A1 4/2007 Bierhuizen et al.
(Continued)

FOREIGN PATENT DOCUMENTS

CN 2159562 Y 3/1994
CN 104756264 A 7/2015
(Continued)

OTHER PUBLICATIONS

Chinese Office Action based on counterpart application No. 201680062793.7 (7 pages) dated Jul. 3, 2019.
(Continued)

*Primary Examiner* — Evan P Dzierzynski

(57) ABSTRACT

According to the present disclosure, an illumination apparatus includes a pump radiation source for emitting pump radiation, a phosphor element for converting the pump radiation into conversion light and a carrier, on which the phosphor element is mounted, which carrier is made of a carrier material which is transparent at least for the pump radiation and has a refractive index $n_{carrier}$. The pump radiation passes through the carrier, exits at an exit surface of the carrier and is then incident on a pump radiation input coupling surface of the phosphor element that is arranged at the exit surface. The pump radiation in the carrier is incident on the exit surface of the carrier with a centroid direction, which centroid direction is inclined with respect to a surface normal on the exit surface by an exit angle $\theta_{out} \neq 0°$, and $\theta_{out} < \theta_c$ with $\theta_c = \arcsin(1/n_{carrier})$.

16 Claims, 4 Drawing Sheets

(51) Int. Cl.

| | |
|---|---|
| ***F21S 43/13*** | (2018.01) |
| ***F21S 41/16*** | (2018.01) |
| ***F21V 9/30*** | (2018.01) |
| ***F21S 41/14*** | (2018.01) |
| ***F21S 43/31*** | (2018.01) |
| ***F21S 45/70*** | (2018.01) |
| *F21Y 115/30* | (2016.01) |

(52) U.S. Cl.

CPC ..... *F21S 43/13* (2018.01); *F21S 43/31* (2018.01); *F21S 43/315* (2018.01); *F21S 45/70* (2018.01); *F21V 9/30* (2018.02); *F21Y 2115/30* (2016.08)

(56) References Cited

U.S. PATENT DOCUMENTS

| | | | | |
|---|---|---|---|---|
| 2011/0157865 | A1 | 6/2011 | Takahashi et al. | |
| 2012/0140436 | A1 | 6/2012 | Yang et al. | |
| 2012/0236536 | A1 | 9/2012 | Harada | |
| 2014/0132937 | A1 | 5/2014 | Daniels | |
| 2014/0340918 | A1* | 11/2014 | Suckling | F21V 9/08 362/510 |
| 2015/0159820 | A1* | 6/2015 | Lee | F21K 9/64 362/84 |
| 2015/0167905 | A1 | 6/2015 | Khrushchev | |
| 2017/0108190 | A1 | 4/2017 | Hadrath | |

FOREIGN PATENT DOCUMENTS

| | | | |
|---|---|---|---|
| DE | 102012209593 | A1 | 12/2013 |
| DE | 102012211915 | A1 | 1/2014 |
| EP | 2541129 | A2 | 1/2013 |
| WO | 2013094221 | A1 | 6/2013 |
| WO | 2013182450 | A1 | 12/2013 |
| WO | 2014009289 | A1 | 1/2014 |
| WO | 2015121123 | A1 | 8/2015 |

OTHER PUBLICATIONS

German Search Report based on application No. 10 2015 220 948.2 (7 pages) dated Sep. 5, 2016 (for reference purpose only).

International Search Report based on application No. PCT/EP2016/073705 (6 pages + 3 pages English translation) dated Jan. 2, 2017 (for reference purpose only).

* cited by examiner

LIGHTING DEVICE COMPRISING A PUMP RADIATION SOURCE

RELATED APPLICATIONS

The present application is a national stage entry according to 35 U.S.C. § 371 of PCT application No.: PCT/EP2016/073705 filed on Oct. 5, 2016, which claims priority from German application No.: 10 2015 220 948.2 filed on Oct. 27, 2015, and is incorporated herein by reference in its entirety.

TECHNICAL FIELD

The present disclosure relates to an illumination apparatus having a pump radiation source for emitting pump radiation and a phosphor element for converting the pump radiation into conversion light.

BACKGROUND

Light sources having high luminance can be realized with the combination of a pump radiation source having a high power density, such as a laser, and a phosphor element that is arranged at a distance therefrom and emits conversion light upon excitation with the pump radiation. During operation in transmission, the pump radiation is here incident on a pump radiation input coupling surface, and the conversion light is output at a conversion light output coupling surface of the phosphor element, which is opposite with respect to the former, and used for illumination purposes. It is here not necessary for the entire pump radiation to be converted (complete conversion), but a non-converted part thereof can also be used, downstream of the phosphor element, together with the conversion light in a mixture (partial conversion).

The conversion light is typically emitted in Lambertian fashion at the conversion light output coupling surface. Even if the pump radiation upstream of the phosphor element is generally focused, i.e. a corresponding beam has an opening angle of only a few degrees, in the case of the partial conversion, the non-converted part of the pump radiation is then fanned out downstream of the phosphor element in a manner that is comparable to the conversion light, for example owing to scatter processes in the phosphor element.

SUMMARY

The present disclosure is based on the technical problem of specifying a particularly advantageous illumination apparatus.

According to the present disclosure, this object is achieved by way of an illumination apparatus having a pump radiation source for emitting pump radiation, a phosphor element for converting the pump radiation into conversion light, and a carrier on which the phosphor element is mounted, which carrier is made of a carrier material which is transparent at least for the pump radiation and has a refractive index $n_{carrier}$, wherein the pump radiation passes through the carrier, exits at an exit surface of the carrier and is then incident on a pump radiation input coupling surface of the phosphor element arranged at the exit surface, wherein the pump radiation in the carrier is incident on the exit surface of the carrier with a centroid direction, which centroid direction is inclined with respect to a surface normal on the exit surface by an exit angle $\theta_{out} \neq 0°$, and wherein $\theta_{out} < \theta_c$ with $\theta_c = \arcsin(1/n_{carrier})$.

Preferred configurations can be gathered from the dependent claims and the entire disclosure, wherein apparatus and method or use aspects are not always specifically differentiated in the illustration; in any case, the disclosure should be read implicitly with respect to all claim categories.

In summary, the phosphor element operated in transmission is mounted on the carrier, with its pump radiation input coupling surface facing toward the carrier, in other words the pump radiation passes through the carrier toward the phosphor element. The conversion light and possibly a non-converted part of the pump radiation are output at the conversion light output coupling surface that is remote from the carrier. According to the present disclosure, pump radiation source and carrier are arranged relative to one another such that the pump radiation in the carrier is incident on its exit surface in an inclined fashion, specifically the exit angle is $\theta_{out} \neq 0°$, e.g. $\theta_{out} \geq 5°$, 10°, 15° or 20° (with increasing preference in the order of mention); on the other hand, said inclination is also upwardly limited ($\theta_{out} < \theta_c$), with $\theta_c$ being the critical angle for total internal reflection.

One advantage of this inclined incident radiation arises in the case of an error, for example if the phosphor element falls off the carrier due to a defective mechanical connection. If the pump radiation were not inclined in this case of an error, but would strike the exit surface perpendicularly, it would propagate exactly in an illumination optical unit that is actually provided for outputting the conversion light (possibly having non-converted, yet fanned-out pump radiation) and thus toward the illumination application. This can represent a significant source of danger and, in the worst case, result in a total loss of vision for an observer. Due to the inclination, the pump radiation is at least not fully coupled into the illumination optical unit in the case of an error; it is advantageously largely guided past it, with particular preference entirely (cf. the angles that are concretized for a minimum inclination below).

The phosphor element can be applied, for example, directly on the carrier or be connected thereto via a joint layer, such as an adhesive layer. In any case, during normal operation, a material adjoins the exit surface of the carrier, the refractive index of which is approximately comparable to $n_{carrier}$ of the carrier material. In the case of an error (fallen-off phosphor element), it is air that adjoins the exit surface. By limiting the inclination angle ($\theta_{out} < \theta_c$), total internal reflection of the pump radiation at the exit surface is then avoided, or at least largely avoided. This can be advantageous for example in as far as, for increasing efficiency during normal operation, a reflection surface is advantageously provided for recycling backscattered conversion light and typically also non-converted, backscattered pump radiation (see below in detail), but via which, in the case of an error, pump radiation that has been totally reflected at the exit surface of the carrier could travel toward the illumination application.

For the centroid direction on which quantification of the inclination is based, the pump radiation within the carrier is taken into consideration, how it is incident on the exit surface thereof, i.e. the refraction upon exit is not taken into consideration. The "centroid direction" is here produced as an average value of all direction vectors along which pump radiation propagates (during the formation of the average value, each direction vector is weighted with the associated radiant intensity). Here, only the pump radiation in the beam propagating directly from the pump radiation source to the phosphor element is considered, i.e. for example backscattered pump radiation which is then still guided to the phosphor element again is not taken into account. The pump radiation on which the centroid direction is based reaches the phosphor element without reflection, at least starting from the first time it passes an entry surface of the carrier, advantageously generally.

The surface normal on the (advantageously planar) exit surface points to the outside, away from the carrier (does not pass through it), i.e. in the direction of the phosphor element. The surface normal is located in the surface centroid of the exit surface, although the exit surface is advantageously planar and the positioning of the surface normal to this extent has no influence on $\theta_{out}$.

For the further, or complete, avoidance of total internal reflections (see above), the exit angle is advantageously $\theta_{out}<0.95\cdot\theta_c$, with particular preference $\theta_{out}<0.9\cdot\theta_c$. The critical angle $\theta_c$ depends on the refractive index $n_{carrier}$ of the carrier material ($\theta_c=\arcsin(1/n_{carrier})$). For the refractive index $n_{carrier}$ of the carrier material, lower limits can be, for example, at least 1.35, 1.4, 1.45 or 1.5 and (independently thereof) upper limits can be, for example, at most 2.2, 2.1, 2.0, 1.9 or 1.8 (in each case with increasing preference in the order of mention). Generally, within the context of this disclosure, refractive indices at a wavelength of 450 nm are taken into consideration. One preferred carrier material is sapphire, which means that the critical angle $\theta_c$ is then approximately 34°.

The phosphor element can be for example a phosphor that has been applied in particulate form; "phosphor" can also be read on a mixture of several individual phosphors. The phosphor element can also be, for example, a phosphor ceramic. Mounting "to" the carrier can refer both to a phosphor element that has been applied directly to the carrier, i.e. adjoins the exit surface thereof directly, and to a phosphor element which is mounted for example by way of a joint layer.

In a preferred configuration, a lower limit is specified for the exit angle θ, specifically $\theta_{out}\geq\arcsin((1/n_{carrier})\cdot\sin(60°))$, advantageously $\theta_{out}\geq\arcsin((1/n_{carrier})\cdot\sin(65°))$, with further preference $\theta_{out}\geq\arcsin((1/n_{carrier})\cdot\sin(70°))$ or $\theta_{out}\geq\arcsin((1/n_{carrier})\cdot\sin(75°))$, with particular preference $\theta_{out}))\geq\arcsin((1/n_{carrier})\cdot\sin(77°))$. In the case of an error, the pump radiation is thus refracted from a corresponding used light cone with a half-opening angle of 60°, 65°, 70°, 75° or 77°. With a view to achieving good efficiency (generally Lambertian conversion light emission), an illumination optical unit assigned to the conversion light output coupling surface in general has an aperture angle of at least 110°, 120°, 130°, 140° or 150°; possible upper limits can be (independently thereof) for example at most 160°, 155° or 150° (in each case with increasing preference in the order of mention).

The aperture angle of the illumination optical unit specifies the used light cone, i.e. the angular range from which conversion light is "collected." Accordingly, in the case of an error, pump radiation that is refracted from this angular range is not coupled into the illumination optical unit. The pump radiation has, upon incidence on the exit surface, at least along a slow axis (narrow axis, see below), an opening angle of advantageously no more than 5°, 4°, 3° or 2°; possible lower limits can be, for example, 0.5° or 1°. Along a fast axis (wide axis, see below), the opening angle can be for example 3 times, 4 times or 5 times greater, and the just mentioned upper and lower limits are also intended to be disclosed as being multiplied by a corresponding factor for the fast axis.

To ascertain the opening angle (this refers to the entire opening angle), the full width at half maximum is taken as the basis (an alternative would be a power drop to 1/e). To the extent that reference is made in the context of this disclosure to the opening angle of a beam or the aperture angle of an optical unit without concretizing along which axis the opening angle is viewed, the respective angle is generally an average value formed around a perimeter around the central axis of the beam or the optical axis of the optical unit. The aperture angle is advantageously constant over the perimeter.

Generally, the illumination optical unit can be imaging or non-imaging, wherein in the latter case optical components that image per se (lenses, mirrors) can also be integrated. In a simple case, the illumination optical unit can be a converging lens which may be optimized for example as an aspheric lens or be made up of a plurality of individual lenses.

At any rate, a radiation absorber is advantageously arranged at the location to which the pump radiation is refracted in the case of an error, for example a plastics part that is coated with an absorbing or dichroic filter; a cooling unit having an entry window that is transmissive for the pump radiation can for example also be provided as a radiation absorber, it being possible for said cooling unit to be filled for example with a radiation absorbing liquid, or an optical (cooled) beam trap can also be provided. Even with a view to possible Fresnel reflections it may be preferred for the radiation absorber to extend circumferentially around the phosphor element, i.e. to enclose it laterally (the lateral directions are perpendicular to the thickness direction of the phosphor element). The radiation absorber can enclose an intermediate space between the phosphor element and the illumination optical unit laterally, advantageously over the entire height of said intermediate space.

One preferred embodiment relates to the reflection surface, already mentioned above, for recycling backscattered conversion light emitted at the pump radiation input coupling surface. The conversion light is emitted in the phosphor element in principle omnidirectionally and thus not only at the conversion light output coupling surface, but also at the opposite pump radiation input coupling surface; with the reflection surface that faces the latter it is possible to increase the conversion light yield and thus the efficiency.

Originally, the backscattered conversion light has a direction component that is parallel to a surface normal on the pump radiation input coupling surface (frequently in combination with a lateral direction component); after reflection, it has a direction component that runs opposite this surface normal. Generally, the reflection surface can also be formed by a dichroic coating and thus be transmissive for the pump radiation. However, the reflection surface is advantageously also reflective for the pump radiation, i.e. for example a metallic reflection surface (reflective over the entire surface) is provided.

In a preferred embodiment that relates in particular to a metallic reflection surface, the reflection surface has a hole-shaped interruption, and the pump radiation is guided from the pump radiation source through said hole to the pump radiation input coupling surface. However, it would generally also be possible for the pump radiation to be guided past the reflection surface. Advantageously, a beam with the pump radiation substantially fills such a hole for example to an extent of at least 75%, 80%, 85% or 90% (with increasing preference in the order of mention); possible upper limits can, for technical reasons, be, for example, at most 98% or 95% (taken into consideration is the surface proportion of the cross-sectional area of the beam, see below, with respect to the area of the hole). The distance between beam and hole edge is advantageously constant around the perimeter.

In a preferred configuration, a curved reflection surface is provided that forms a concave mirror shape, as viewed from the pump radiation input coupling surface. Generally, the reflection surface can also be aspheric, such as ellipsoidal or parabolic, advantageously it is spherical.

In a preferred configuration, the spherical reflection surface and the pump radiation input coupling surface are arranged relative to one another such that the latter is arranged approximately at the center point of a sphere having a radius R that serves as the basis for the spherical reflection surface. For a distance d, extending along a surface normal on the pump radiation input coupling surface, between surface centroid of the pump radiation input coupling surface and reflection surface, in connection with the radius R, advantageously $0.8 \cdot R \leq d \leq 1.2 \cdot R$, with further preference $0.9 \cdot R \leq d \leq 1.1R$. Ideally, conversion light coming from the surface centroid of the pump radiation input coupling surface is guided back into this surface centroid. For example owing to the optical offset in a carrier that is provided as a plane-parallel plate, a certain deviation from the ideal radius R may occur, which the previously mentioned intervals reflect.

The pump radiation input coupling surface has an average extent x, which is obtained as an average value of its smallest and largest extent. The sphere that forms the basis for the spherical reflection surface has a radius R, and then advantageously $R \geq x/2$, wherein further advantageous lower limits for R, with increasing preference in this order, are at least 3x/4, x, 5x/4, 3x/2, 7x/4 or 2x. Advantageous upper limits can be, for example, at most 10x, 8x, 6x, 4x or 3x, with increasing preference in the order of mention (an upper limit can also be of interest independently of a lower limit, and vice versa).

Up to this point, the discussion has primarily dealt with the shape of the reflection surface. There are now two different possibilities for beam guidance between pump radiation input coupling surface and reflection surface, and thus ultimately also for the mounting of the latter. On the one hand, the reflection surface can be arranged at a distance from the carrier (cf. FIG. 1A for illustration purposes) via a gas volume, for example an inert gas or advantageously air; on the other hand, the reflection surface can also be formed directly on the carrier itself, which will be discussed initially below (see FIG. 3).

In a preferred embodiment, the carrier is thus configured as a plano-convex lens, the convex lateral surface of which includes, on the one side, the entry surface, and is partially covered, on the other side, by a reflection layer that forms the reflection surface. The convex lateral surface is advantageously metallically coated, wherein the coating furthermore advantageously has a hole-shaped interruption (see above) for the entry surface.

The plano-convex lens is advantageously planar-spherical, can be with particular preference a hemispherical carrier. In this case, the pump radiation is advantageously coupled in such that the pump radiation beam is perpendicular to the entry surface. The phosphor element is arranged at the planar lateral surface opposite the convex lateral surface.

Where reference is made generally within the context of this disclosure to an entry or exit surface, this relates to the entire region through which the respective radiation passes of a lateral surface of the carrier, which may be larger overall; in other words, only the optically effective partial surfaces are taken into consideration.

In one preferred embodiment relating to the variant "gas volume between carrier and reflection surface," the recycled backscattered conversion light passes through this gas volume between the reflection surface and carrier. This variant can be advantageous over the hemispherical lens for example in as far as, in that case, less carrier material is necessary, which for example in the case of a carrier made of sapphire can offer cost and generally also weight advantages.

In a preferred configuration, the carrier is provided in the form of a plane-parallel plate. Said plate can have in each of its surface directions for example an extent that is greater than in the thickness direction, which is perpendicular thereto, by at least 5, 10, 15 or 20 times; possible upper limits can be for example 200 or 100 times. Arranged on one of the planar lateral surfaces which are arranged opposite one another with respect to the thickness direction is the phosphor element, and the reflection surface rises opposite the other lateral surface in the form of a dome.

In a preferred configuration, the plane-parallel plate is put together with a reflector forming the reflection surface, advantageously in a form-fitting manner. The plane-parallel plate, for example, can be inserted into the reflector and be held for example by a latched fit. The reflector can generally also be, for example, a monolithic metal part, of which one lateral surface then forms the reflection surface; "monolithic" means free of material boundaries between different materials or of materials of different manufacturing history. The reflector is advantageously a plastics molded part, with particular preference an injection molded part that is coated with a reflection layer that forms the reflection surface.

In one preferred embodiment, the pump radiation is incident on the entry surface of the carrier in linearly polarized fashion at an entry angle $\theta_{in} \neq 0$, and here the polarization plane, which is formed by the vectors of the electric field, is inclined with respect to the plane of incidence by at most 20°, with increasing preference in this order at most 15°, 10°, 5° or 2°. Particularly preferred is an angle of 0°, i.e. the two planes coincide; in other words, the pump radiation is p-polarized. The plane of incidence is formed by the entry centroid direction that the pump radiation has immediately upstream of the entry surface (and which is formed as an average value of the direction vectors that are weighted depending on power, see above) and the surface normal in the surface centroid of the entry surface.

With the at any rate substantial p-polarization, it is possible to optimize the efficiency in connection with oblique coupling by way of the entry surface, specifically for example Fresnel losses can be reduced. Due to the p-polarization, the reflection coefficient (at a boundary surface low optical density/high optical density) decreases with increasing inclination with respect to what is known as the Brewster angle $\theta_B$, for example from around 8% at 0° to ideally 0% at $\theta_B$. With radiation which is polarized perpendicularly to the plane of incidence, on the other hand, the reflection losses increase with increasing inclination (likewise from around 8% at 0°).

In a preferred configuration, for the entry angle $\theta_{in}$: $0.5 \cdot \theta_B \leq \theta_{in} \leq 1.3 \cdot \theta_B$, wherein the Brewster angle $\theta_B$ is obtained as $\theta_B = \arctan(n_{carrier}/1$. Further preferred lower limits are $0.6 \cdot \theta_B$, $0.7 \cdot \theta_B$ or $0.8 \cdot \theta_B$ (with increasing preference in the order of mention). The entry angle is obtained from 180° minus an angle that is enclosed by a surface normal in the surface centroid of the entry surface with the entrance centroid direction. In particular, the plane-parallel plate as a carrier permits flat input coupling and correspondingly input coupling that is close to the Brewster angle $\theta_B$.

The entry surface of the carrier can then possibly also be provided entirely without anti-reflection coating, or the latter can at least be simplified.

In a preferred embodiment, the pump radiation has, directly upstream of the exit surface of the carrier, a cross-sectional profile taken perpendicularly to the centroid direction (based on a power drop to a half, cf. full width at half maximum), which has a different extent in two axes that are perpendicular to one another. The extent along a wide axis is intended to correspond at least to 1.2 times, advantageously at least 1.4 times, with particular preference at least 1.6 times, an extent taken along the narrow axis that is perpendicular thereto (possible upper limits are, for example, at most 5, 4 or 3 times). In this case, the narrow axis is inclined with respect to the plane of incidence (see above) by at most 20°, with increasing preference in this order by at most 15°, 10°, 5° or 2°; the narrow axis is situated with particular preference in the plane of incidence.

With a corresponding orientation of the narrow axis, it is possible, in connection with the oblique coupling, for the pump radiation to be spread out along the narrow axis; it is then possible, despite an originally e.g. elliptical cross section, to at any rate excite approximately circularly on the pump radiation input coupling surface. The pump radiation is advantageously already emitted by the pump radiation source with a corresponding cross-sectional profile (with narrow axis=slow axis, and wide axis=fast axis) and the oblique input coupling provides compensation.

The present disclosure also relates to an illumination apparatus in which the pump radiation passes through a converging lens, upstream of the carrier, with an offset with respect to the optical axis of said converging lens. A beam with the pump radiation is incident on the converging lens, passes through it, and is thus guided to the carrier/phosphor element in a advantageously converging manner. A central axis of the beam in a respective section (of interest in the present case is the central axis upstream of the converging lens) parallel with respect to the centroid direction of the pump radiation in the observed section is situated centrally in the beam (in the surface centroid of the cross-sectional profile, see above).

Located directly upstream of the converging lens, this central axis of the pump radiation beam is offset with respect to the optical axis of the converging lens, for example by, with increasing preference in the order of mention, at least 0.01 mm, 0.1 mm, 0.5 mm or 1 mm (possible upper limits can be, for example, 20 mm or 10 mm). Generally, central axis and optical axis can also be additionally inclined with respect to one another, they are advantageously parallel with respect to one another.

Guiding the pump radiation with an offset with respect to the optical axis can be of interest in the case of an error which has not yet been discussed, for example if the converging lens is misaligned during operation of the illumination apparatus or if it falls off completely, for example due to a holder being mechanically damaged. If the pump radiation were not guided with an offset with respect to, but along, the optical axis of the converging lens, then in the case of such an error it would continue to propagate in principle along the same path to the phosphor element; the beam, however, would here have an undefined shape, i.e. would typically be significantly widened, which is why pump radiation could travel laterally past the phosphor element and thus into the illumination optical unit (this would be the case, for example, in FIG. 1A, if the converging lens were not present).

Due to the guidance with an offset with respect to the optical axis, the pump radiation in this case, if a converging lens is present, takes a different path than it would if, for example, the converging lens had fallen off. The pump radiation can in this case of an error be guided for example such that it is not coupled into the carrier, or only to a minor degree. This embodiment "guidance of the pump radiation with an offset with respect to the optical axis of the converging lens," described in the previous paragraphs, is also considered to be a disclosure independently of the features of the main claim, in concrete terms independently of the exit angle $\theta_{out}$, and is also intended to be disclosed in this form; likewise possible is a combination with the remaining configurations which are disclosed as being preferred.

Generally, a laser is preferred as a pump radiation source, with particular preference a laser diode. The pump radiation source can also be composed of a plurality of laser diodes, the respective beams of which can be superposed, for example, so as to coincide. If a plurality of laser diodes are provided, they can differ in terms of their respective dominant wavelength, although the latter is advantageously identical from laser diode to laser diode, with particular preference the laser diodes are of the same design.

In one preferred embodiment, a plurality of pump radiation sources are provided, of which each is designed for emitting pump radiation in the form of a beam. In this case, as long as two of the beams are rotationally symmetric relative to one another with respect to a rotational axis that is perpendicular to the pump radiation input coupling surface, a rotational angle, on which said rotational symmetry is based, is intended to differ from 180°. However, the beams can also be located such that they are not rotationally symmetric with respect to one another at all. However, if they are, then the specification of the rotational angle (≠180°) prevents for example back reflections from one pump radiation source from reaching another pump radiation source, which can help prevent damage.

The present disclosure also relates to the use of an illumination apparatus for illumination, disclosed here, advantageously for motor vehicle illumination, with further preference for external motor vehicle illumination, with particular preference in a front headlight, for example of a car. However, of interest can also be for example use in the tail lights/signal lights, in particular the brake lights; use in the vehicle interior is also feasible.

BRIEF DESCRIPTION OF THE DRAWINGS

The present disclosure will be explained in more detail below with reference to exemplary embodiments, wherein, within the context of the coordinate claims, the individual features can also be essential to the present disclosure in a different combination, and, furthermore, a distinction is not always specifically drawn between the different claim categories.

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1A:
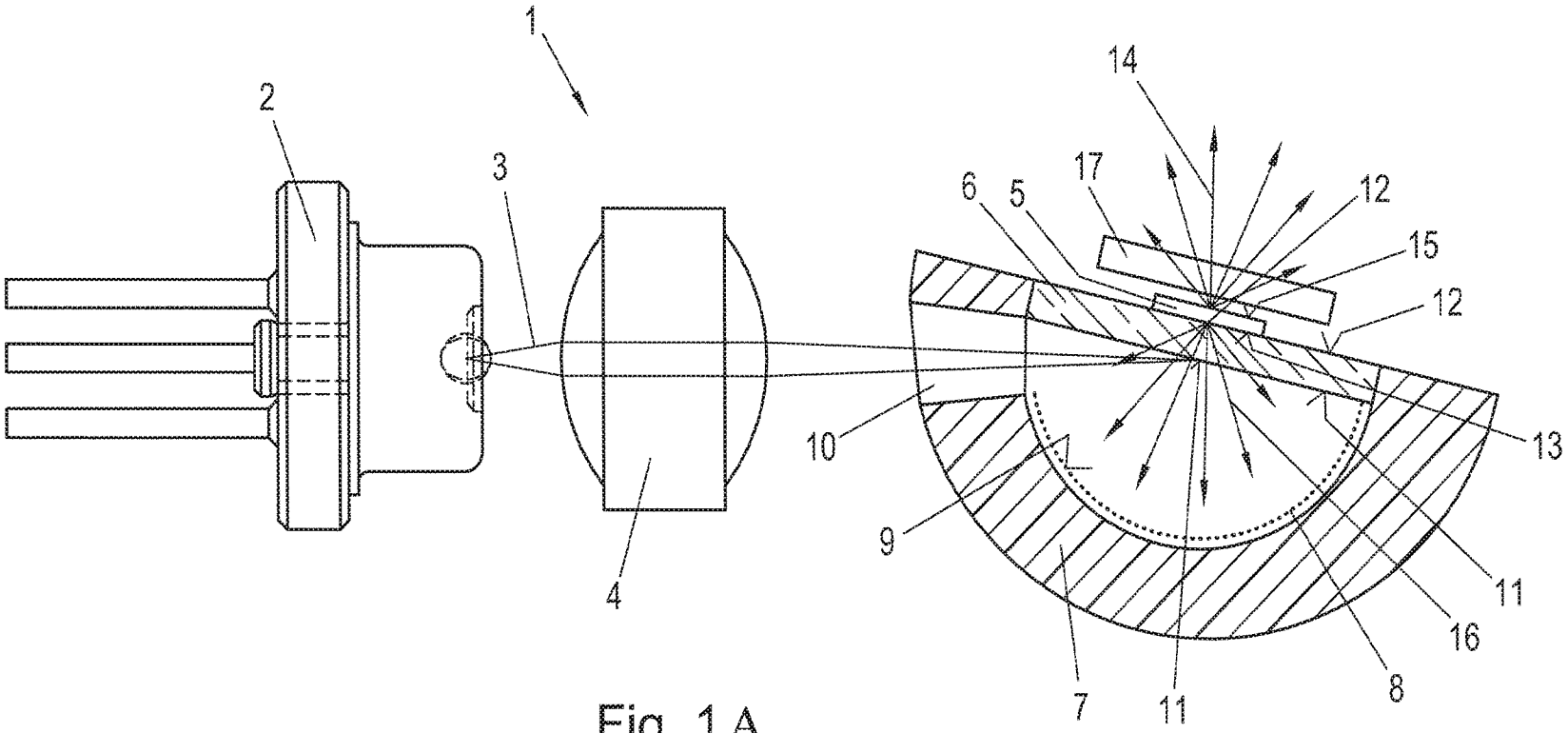
FIG. 1A shows a first illumination apparatus according to the present disclosure having a pump radiation source and a phosphor element in a partially cut side view during normal operation.

FIG. 1 shows an illumination apparatus 1 according to the present disclosure having a pump radiation source 2, specifically a laser diode, for emitting pump radiation 3. Immediately downstream of the pump radiation source 2, the pump radiation 3 passes through a converging lens 4, which focuses the beam with the pump radiation 3. Downstream of the converging lens 4, the pump radiation 3 is guided onto a phosphor element 5, which is applied directly onto a carrier 6.

The carrier 6 is a plane-parallel plate made of sapphire, which has been inserted into a reflector that has the shape of half a hollow sphere. A correspondingly shaped injection molded part 7 made of polycarbonate, which is coated on the inside with a silver layer 8, forms the reflector. The silver layer 8 forms a reflection surface 9 that faces the carrier 6 and the phosphor element 5 and the function of which will become clear in the context of the operation of the illumination apparatus 1 described below.

In order to be able to couple the pump radiation 3 into the just described arrangement, the injection molded part 7 includes an interruption 10 through which the pump radiation 3 can pass inside from outside the hollow sphere. The pump radiation 3 then enters the carrier 6 at an entry surface 11, exits at an opposite exit surface 12, and is then incident on a pump radiation input coupling surface 13 of the phosphor element 5. The phosphor element 5 is made of cerium-doped yttrium aluminum garnet (YAG:Ce) and is excited with the pump radiation (in the present case, blue pump light having a dominant wavelength of 450 nm).

Upon this excitation, the phosphor element 5 emits a conversion light 14 at a conversion light output coupling surface 15 that is located opposite the pump radiation input coupling surface 13. However, upon excitation with the pump radiation 3, conversion light is emitted in principle omnidirectionally, that also means a backscattered conversion light 16 is emitted at the pump radiation input coupling surface 13. In order to also make this useful for the illumination, the reflection surface 9 is provided, at which the backscattered conversion light 16 is reflected and in this way guided back in the direction of the phosphor element 5. The conversion light 14, which was originally emitted at the conversion light output coupling surface 15, is then focused, together with the thus recycled backscattered conversion light 16, using an illumination optical unit 17 (only schematically indicated in the present case) and guided to the illumination application. In a simple case, the illumination optical unit can also merely be a plane-parallel plate, or such a plane-parallel plate can form the first optical element of the optical unit, in that case a combination with a plurality of lenses is preferred.

Figure 1B:
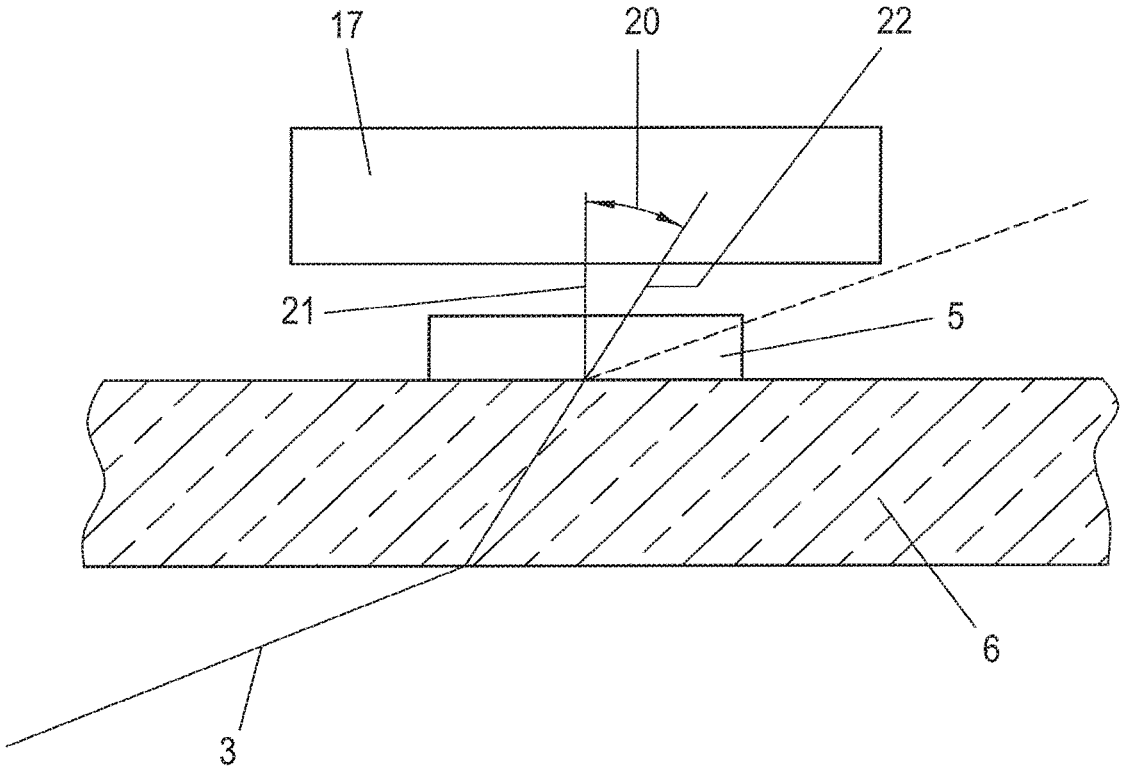
FIG. 1B shows a schematic illustration, in supplementation of FIG. 1A, for illustrating the angle during the pump radiation input coupling.

FIG. 1B shows a schematic detail view of FIG. 1A, specifically for illustrating the angles during the pump radiation guidance. The pump radiation 3 is coupled into the carrier 6 obliquely with respect to the entry surface 11 (FIG. 1A) of the carrier 6 such that it is incident on the exit surface 12 (cf. FIG. 1A) of the carrier 6 at an exit angle 20 ($\theta_{out}$). The exit angle 20 is the one between a surface normal 21 on the exit surface of the carrier 6 and a centroid direction 22 which the pump radiation 3 has within the carrier 6. The exit angle 20 is here smaller than the critical angle $\theta_c$ for total internal reflection (34° for sapphire); yet at the same time it is ≥33°, with the latter angle being obtained from $\arcsin((1/n_{Saphir})\cdot\sin(77°))$.

The illumination optical unit 17 has an aperture angle of 150°, consequently a used light cone, that is to say the conversion light guided via the illumination optical unit 17 (including partially non-converted pump radiation) has a half-opening angle of 75°. With the just mentioned lower limit for the exit angle 20 it is possible to ensure that, in the case of an error if the phosphor element 5 falls off the carrier 6, the pump radiation is not, or at least not to any major extent, coupled into the illumination optical unit 17. As is schematically indicated by the dashed line in FIG. 1B, the pump radiation in this case is refracted past the illumination optical unit 17, and dangerous propagation of focused pump radiation via the illumination optical unit 17 can be avoided. Reference is also made to the detailed discussion in the introductory part of the description.

Figure 2:
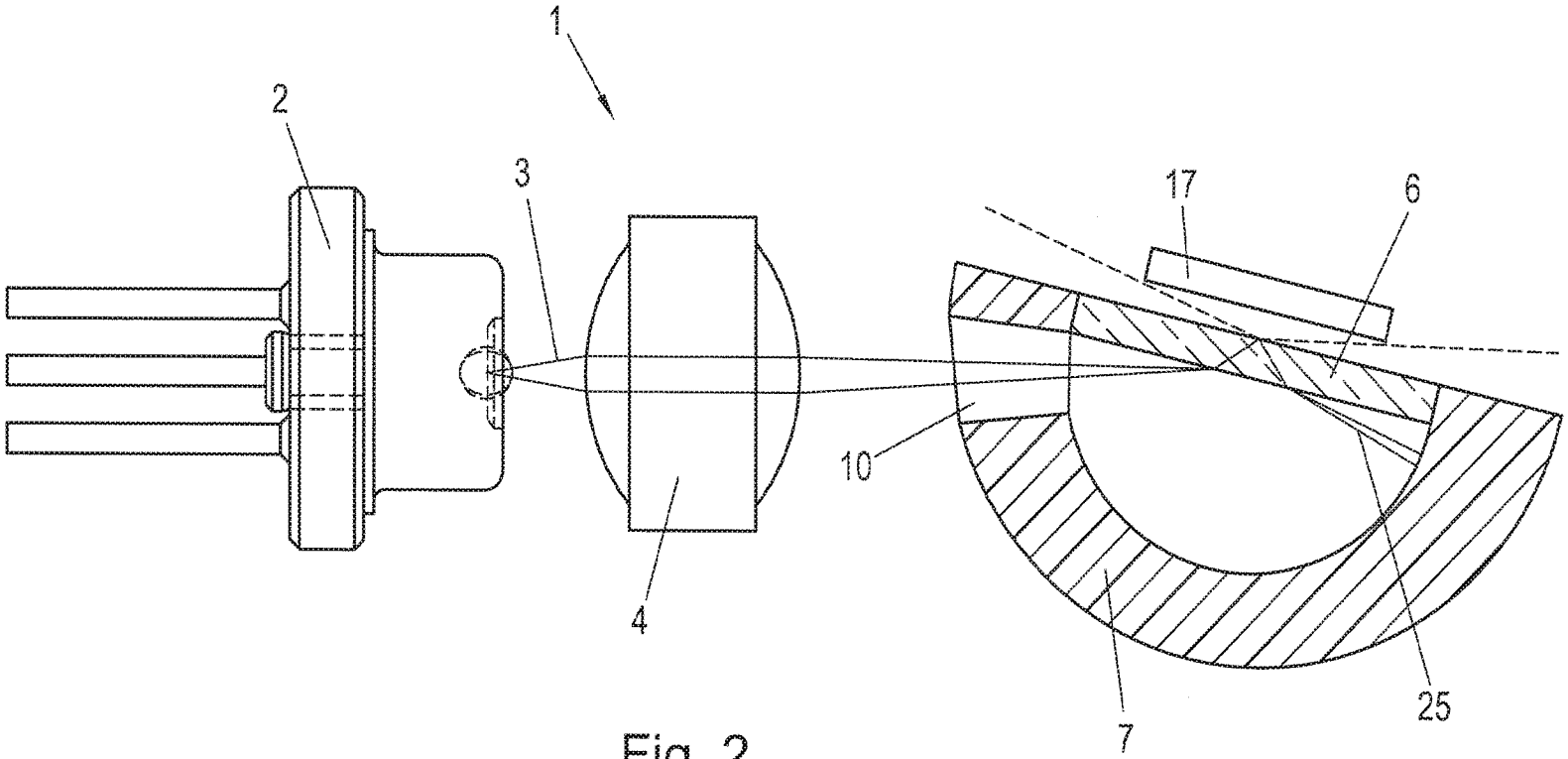
FIG. 2 shows the illumination apparatus in accordance with FIG. 1A in the case of an error, specifically if a phosphor element is not present.

FIG. 2 illustrates the case of the error further in detail for the illumination apparatus of FIG. 1A, wherein the representation is based on a raytracing simulation by the inventor. The phosphor element has fallen off, and for this reason the pump radiation, as is explained with reference to FIG. 1B, is laterally refracted at the exit surface 12 of the carrier 6. In the underlying simulation, losses at the boundary surfaces are additionally taken into account, because reflections occur both at the entry surface 11 and at the exit surface 12 (Fresnel losses). The reflection coefficients are below 20%, but even this portion of the pump radiation can become a problem in the case of propagation via the illumination optical unit 17. Even if an anti-reflective coating is applied at the boundary surfaces of the carrier 6, the reflections cannot be entirely avoided.

In FIG. 2, a corresponding portion of the pump radiation reflected at the exit surface 12 of the carrier 6, said portion making up around 10% of the pump radiation that is incident on the exit surface 12 (with respect to the radiant power), is denoted with the reference sign 25. This pump radiation reflected at the exit surface 12 is incident on the reflection surface 9, is reflected here back in the direction of the carrier 6, passes through it, and is refracted out of the used light cone due to the symmetric setup like the pump radiation that originally exited at the exit surface 12, only to the other side (to the top left in the figure). In summary, even taking into account reflection losses occurring in reality in the case of an error, it is possible for propagation of the pump radiation via the illumination optical unit 7 to be avoided.

During normal operation, i.e. with the phosphor element 5 present, the entire pump radiation 3 is not converted in the phosphor element 5, but a non-converted part of the pump radiation 3 together with the conversion light 14 (and also with the recycled backscattered conversion light 16) forms the illumination light. The non-converted pump radiation is in this case, however, scattered in the phosphor element 5, i.e. fanned out, therefore does not propagate in a focused form in the illumination optical unit 17.

The oblique coupling of the pump radiation 9 onto the entry surface 11 of the carrier 6 is furthermore also advantageous in as far as the pump radiation 3 is linearly polarized, specifically p-polarized. That means, a polarization plane including the vectors of the electric field of the pump radiation thus coincides with the plane of incidence (in the present case the drawing plane). This is advantageous in as far as in that case, with increasingly inclined input coupling, the reflection coefficient that determines the Fresnel losses (at the transition air/sapphire) decreases from around 10% to what is known as the Brewster angle $\theta_B$, cf. also the statements in the introductory part of the description.

Figure 3:
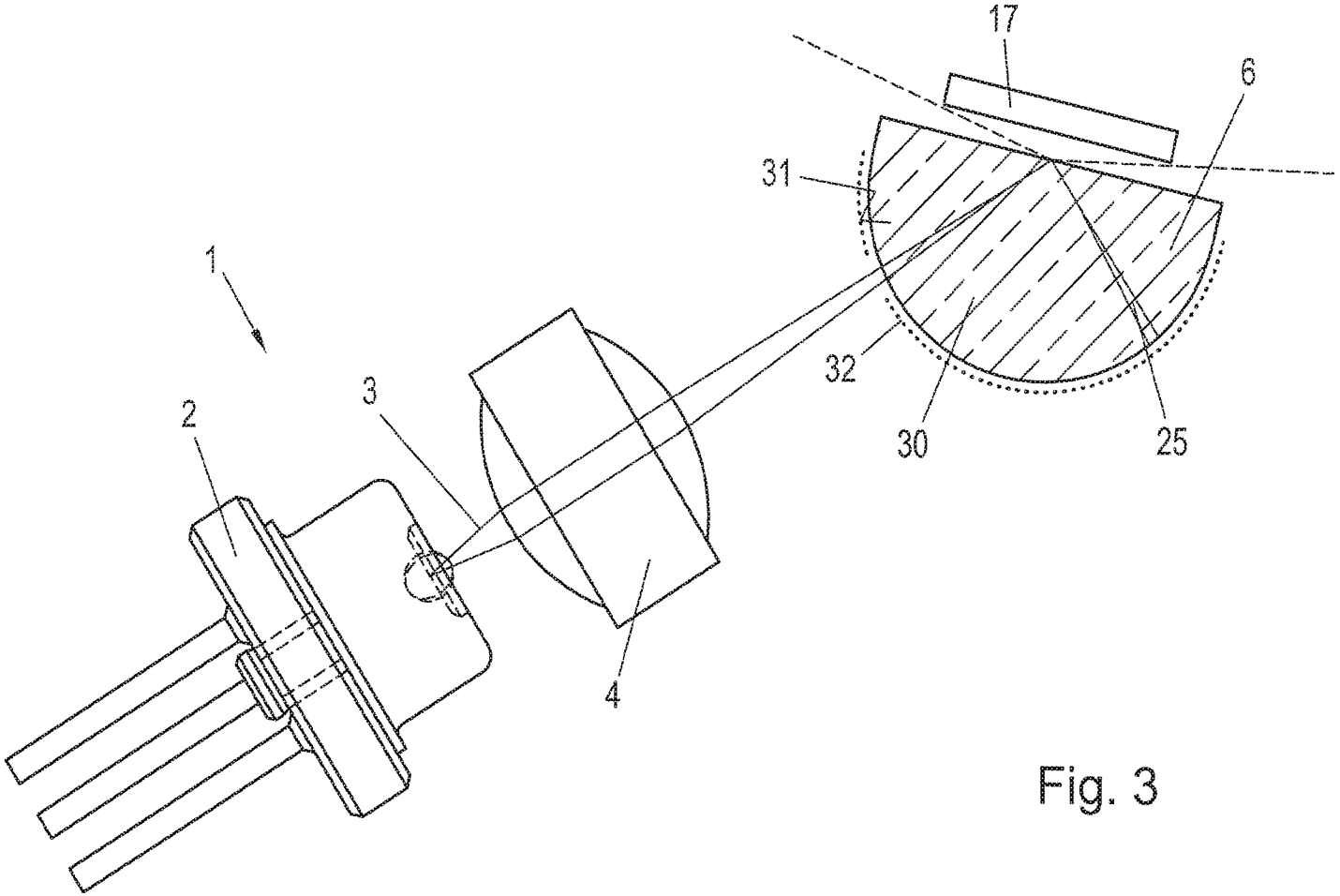
FIG. 3 shows a second illumination apparatus according to the present disclosure in a partially cut side view, specifically likewise in the case of an error similar to FIG. 2.

FIG. 3 shows a further illumination apparatus 1 according to the present disclosure, which corresponds to that in accordance with FIG. 1A as far as the pump radiation source 2, the converging lens 4 and also the relative arrangement of phosphor element 5 and illumination optical unit 17 are concerned. The pump radiation 3 is guided to the phosphor element 5, similar to the description regarding FIG. 1B. In the possible case of an error, i.e. if the phosphor element is not present, the pump radiation is then refracted from the used light cone, as in the case of the above-described embodiment. In general, in the context of this disclosure, identical reference signs denote parts having the same function, and, to this extent, reference is always also made to the description relating to the other figures.

In the illumination apparatus in accordance with FIG. 3, the carrier 30 provided is not a plane-parallel plate, but a hemisphere made of sapphire. Arranged on the planar side of it is the phosphor element 5, while the convex side is coated with a reflection layer 32 made of silver that forms a reflection surface 31. The resulting reflection surface 31 is, like the above-mentioned reflection surface 9, spherical and serves for recycling the backscattered conversion radiation 16 and a part of the pump radiation that is scattered back at the pump radiation input coupling surface 13. In the present case, the pump radiation 3 is coupled in perpendicularly to the spherical-convex lateral surface of the hemisphere.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An illumination apparatus (1), comprising a pump radiation source (2) for emitting pump radiation (3), a phosphor element (5) for converting the pump radiation (3) into conversion light (14,16) and a carrier (6), on which the phosphor element (5) is mounted, which carrier (6) is made of a carrier material which is transparent at least for the pump radiation (3) and has a refractive index $n_{carrier}$, wherein the pump radiation (3) passes through the carrier (6), exits at an exit surface (12) of the carrier (6) and is then incident on a pump radiation input coupling surface (13) of the phosphor element (5) that is arranged at the exit surface (12), wherein the pump radiation (3) in the carrier (6) is incident on the exit surface (12) of the carrier (6) with a centroid direction (22), which centroid direction (22) is inclined with respect to a surface normal (21) on the exit surface (12) by an exit angle (20) $\theta_{out} \neq 0°$, wherein $\theta_{out} < \theta_c$ with $\theta_c = \arcsin(1/n_{carrier})$; and wherein, in a condition of the phosphor element (5) being dismounted from the carrier (6) and optically decoupled from light exiting the exit surface (12), a lower limit angle of the exit angle (20) is given by $\theta_{out} \geq \arcsin$.

2. The illumination apparatus as claimed in claim 1, having a reflection surface which faces the pump radiation input coupling surface such that at least a part of a backscattered conversion light which is emitted at the pump radiation input coupling surface is reflected at the reflection surface back in the direction of the phosphor element.

3. The illumination apparatus as claimed in claim 2, wherein the reflection surface is interrupted by a hole-shaped interruption through which the pump radiation propagates from the pump radiation source to the pump radiation input coupling surface of the phosphor element.

4. The illumination apparatus as claimed in claim 2, wherein the reflection surface has the shape of a concave mirror, viewed from the pump radiation input coupling surface of the phosphor element.

5. The illumination apparatus as claimed in claim 4, wherein the reflection surface is spherical, wherein a surface centroid of the pump radiation input coupling surface has a distance d, extending along a surface normal on the pump radiation input coupling surface, from the spherical reflection surface, and a sphere on which the spherical reflection surface is based has a radius R, wherein $0.8 \cdot R < d < 1.2 \cdot R$.

6. The illumination apparatus as claimed in claim 4, wherein the carrier is configured as a plano-convex lens, the convex lateral surface of which includes an entry surface at which the pump radiation enters the carrier, and at the planar side of which the phosphor element is arranged, wherein a reflection layer forming the reflection surface is applied on the convex lateral surface of the carrier and partially covers it.

7. The illumination apparatus as claimed in claim 4, wherein an entry surface of the carrier at which the pump radiation enters the carrier and the reflection surface are arranged at a distance from one another via a gas volume through which the part of the backscattered conversion light that is reflected at the reflection surface back in the direction of the phosphor element passes.

8. The illumination apparatus as claimed in claim 7, wherein the carrier is configured as a plane-parallel plate.

9. The illumination apparatus as claimed in claim 8, wherein the carrier, which is configured as a plane-parallel plate, is put together with a reflector forming the reflection surface.

10. The illumination apparatus as claimed in claim 1, wherein the pump radiation is incident on an entry surface of the carrier in linearly polarized fashion at an entry angle $\theta_{in} \neq 0$, and a polarization plane, formed by vectors of the electric field, is inclined with respect to a plane of incidence by at most 20°.

11. The illumination apparatus as claimed in claim 10, wherein the carrier is configured as a plane parallel plate, wherein $0.5.0 \cdot \theta_B \leq \theta_{in} \leq 1.3 \cdot \theta_B$, with $\theta_B = \text{arCtan}(n_{carrier}/1)$.

12. The illumination apparatus as claimed in claim 1, wherein the pump radiation has, immediately upstream of the exit surface, a cross-sectional profile whose maximum extent, along a wide axis, corresponds to at least 1.2 times an extent along a narrow axis, which is perpendicular to the former, wherein the narrow axis is inclined with respect to a plane of incidence by at most 20°.

13. The illumination apparatus as claimed in claim 1, wherein the pump radiation, upstream of the carrier, passes through a converging lens that has an optical axis, wherein the pump radiation is incident on the converging lens with an offset with respect to the optical axis, i.e. a central axis of the beam with the pump radiation is offset with respect to the optical axis upstream of the converging lens.

14. The illumination apparatus as claimed in claim 1, having a plurality of pump radiation sources which are each configured for emitting pump radiation in the form of a beam, wherein, to the extent that two of the beams are rotationally symmetric relative to one another with a rotational axis that is perpendicular to the pump radiation input coupling surface, a rotational angle on which said rotational symmetry is based differs from 180°.

15. The use of an illumination apparatus as claimed in claim 1 for illumination.

16. The illumination apparatus as claimed in claim 1, further comprising an illumination optical unit (17) optically coupled to light exiting the phosphor element (5) and having a light collection aperture angle that is not in excess of two times said lower limit angle.

* * * * *